United States Patent [19]

Murayama

[11] Patent Number: 4,547,250

[45] Date of Patent: Oct. 15, 1985

[54] APPARATUS FOR AFFIXING LABELS TO MOVING WEB

[75] Inventor: Kosho Murayama, Kawasaki, Japan

[73] Assignee: Dai Nippon Insatsu Kabushiki Kaisha, Japan

[21] Appl. No.: 538,519

[22] Filed: Oct. 3, 1983

[30] Foreign Application Priority Data

Oct. 8, 1982 [JP] Japan ..... 57-177171

[51] Int. Cl.[4] ..... B65C 9/18; B65C 9/46

[52] U.S. Cl. ..... 156/384; 156/542; 156/552; 156/584; 156/DIG. 33; 156/DIG. 40; 156/DIG. 47

[58] Field of Search ..... 156/384, 361, 541, 552, 156/DIG. 39, 40, 47, 33, 542, 584

[56] References Cited

U.S. PATENT DOCUMENTS

| | | | |
|---|---|---|---|
| 3,970,506 | 7/1976 | Kwan et al. | 156/361 |
| 4,267,004 | 5/1981 | Anderson | 156/361 |
| 4,270,968 | 6/1981 | Dudzik et al. | 156/361 |
| 4,488,925 | 12/1984 | Craig et al. | 156/542 |

*Primary Examiner*—Michael Wityshyn
*Attorney, Agent, or Firm*—Parkhurst & Oliff

[57] ABSTRACT

A defect on a moving web such as a printed sheet of paper is detected visually or automatically, and the type of defect thus detected is marked by means of a stamping unit on a label of a label tape consisting of a base strip and a number of labels removably secured to the base strip. Thereafter, the base strip of the label tape is advanced and reversed abruptly in its moving direction, whereby the label is partially separated from the base strip. The label thus partially separated is then pressed against the moving web by means of a pressure roller. At the instant of pressing of the label against the web, abrupt variation in tension of the label tape occurs, which variation or shock is absorbed by movement of a swing roller on a swing arm in the direction of movement of the web. The label tape is passed around the swing roller and then directed downwardly. The swing arm is supported by means of a spring, and when the swing roller is moved, the spring is extended. The absorption of the shock prevents any adverse effects such as tearing and wrinkling of the label being affixed.

12 Claims, 13 Drawing Figures

APPARATUS FOR AFFIXING LABELS TO MOVING WEB

BACKGROUND OF THE INVENTION

The present invention relates to an apparatus for affixing labels to a moving web and, more particularly, to an apparatus for affixing labels to a moving web in which sudden variation in tension of a label tape caused when a label separated from its base strip is affixed to a traveling web can be relieved and absorbed by an accompanying movement of the label tape in the direction of travel of the web, whereby regardless of variations in the traveling speed of the label tape, labels can be affixed to the traveling web without causing tearing and wrinkling of the labels and the traveling web.

In the printing, web coating or web laminating process, various defects occur. Therefore, it is required to mark instantaneously the positions of defects of a traveling web so that the positions and types of defects can be determined. Unless such marking is employed, the positions and types of defects cannot be found after the web has been rolled. Therefore, a slip or the like recording the positions and types of defects must be prepared by the operator in the printing factory or the like and be sent to the succeeding station of the production line for checking. However, if the slip or the like is lost, it becomes impossible to detect the positions and know the types of defects.

The conventional methods for indicating defects of a traveling web are (1) marking by spraying, (2) marking with ink rolls, felt pens or stamps, (3) inserting a strip of paper, (4) marking with notches, (5) marking with an ink jet and (6) affixing labels. Such methods have their inherent merits and demerits. In the case of (1), the spray nozzle tends to be clogged; ink drips; a portion without defect is marked; and it is difficult to find the positions of defects from the side face when the web is rolled. In the case of (2), marked positions cannot be clearly distinguished and it is impossible to find the positions of defects from the side face of the rolled web. In the case of (3), it is difficult to exactly detect the defects; the defects within the interior of the rolled web cannot be found; and when the rolled web is unrolled, the strip of paper is dropped. In the case of (4), the web is partially cut out and it is impossible to find the defects from the side face of the rolled web. In the case of (5), the ink nozzle tends to be clogged because ink is dried and it is impossible to find the defects from the side face of the rolled web. In the case of (6), the web and the labels tend to be torn off or wrinkled because the traveling speed of the web is not equal to the speed at which the label is pushed forward against the surface of the web. However, this method of affixing labels to the web is considered most advantageous among the above stated defect indicating methods.

In the conventional apparatus for affixing a label to a traveling web, the label must be pushed against the web at the same component traveling speed as the web in the instant of affixing operation. It follows therefore that when the traveling speed of the web varies, the component speed in the direction of the movement of the web at which the label is pushed forward must be varied accordingly. As a result, the labeling apparatus is very complicated in construction.

SUMMARY OF THE INVENTION

An object of the present invention is to provide an apparatus for affixing labels to a moving web wherein it is not necessary to push the labels against the web with the same component traveling speed along the web as the moving web, and wherein the labels can be affixed to the web regardless of its traveling speed.

According to the present invention, the type of defect detected is marked on a label of a label tape which is held stationary, and then the base strip of the label tape is advanced and abruptly reversed in its moving direction, whereby the label removably secured to the surface of the base strip is partially separated from the base strip due to the stiffness of the label. The label thus partially separated is then pressed against the moving web. At the instant the label is pressed against the web, abrupt variation in tension of the label tape occurs, which variation is relieved or absorbed by a movement of the label tape in the direction of movement of the web. As a result, regardless of the traveling speed of the web, the label can be affixed thereto without causing adverse effects such as tearing and wrinkling of the label and the web. The movement of the label tape in the direction of movement of the web is made possible by means of a resiliently supported movable roller around which the label tape is passed.

The features which are believed to be characteristic of the present invention are set forth in the appended claims. The invention itself, however, both as to its organization and method of operation, will best be understood from the following detailed description taken in connection with the attached drawings.

DESCRIPTION OF THE PREFERRED EMBODIMENTS

Figure 1:
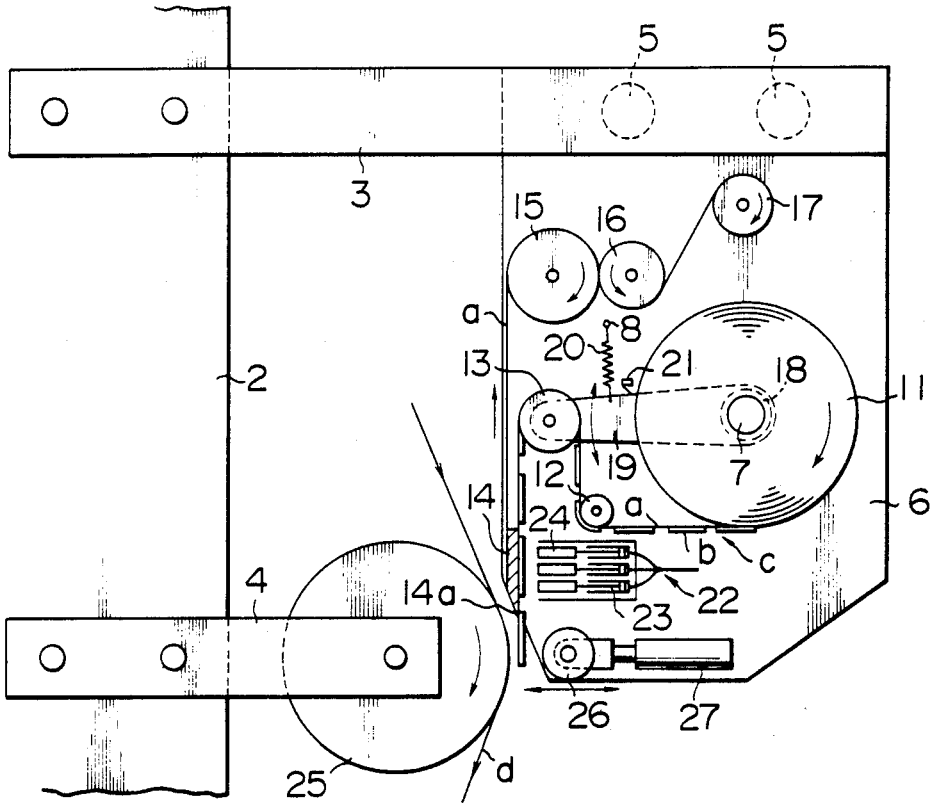
FIG. 1 is a side elevation, partly in section, of a first form of the apparatus in accordance with the present invention.

Referring to FIG. 1, the device for affixing labels to a moving web shown therein has a machine frame 2, to which a pair of upper horizontal brackets 3 (only one can be seen) and a pair of lower horizontal brackets 4 (only one can be seen) are fixed. The upper brackets 3 are connected by means of two guide rods 5 by which a vertical supporting plate 6 is supported at the upper part thereof. The supporting plate 6 is movable along the guide rods 5 and can be locked in any adjusted position along the guide rods 5.

A label tape supply roll 11 is supported rotatably on the supporting plate 6 by means of a shaft 7. A label tape c consisting of a base strip a and labels b removably affixed thereto is wound around the label tape supply roll 11. The label tape c paid out from the supply roll 11 is passed around a guide roller 12 and a movable swing roller 13 toward the lower edge 14*a* of a vertically extending separating plate 14. The guide roller 12 is rotatably mounted on the supporting plate 6 while the separating plate 14 is fixed to the supporting plate 6. At the edge 14*a* of the separating plate 14 the base strip a of the label tape c is reversed in direction; that is, extended upward and passes between a drive roller 15 and a pinch roller 16, which are supported on the supporting plate 6, and is wound around a take-up roller 17. An electromagnetic brake 18 is provided on the shaft 7 of the supply roll 11. The swing roller 13 is mounted at one end of a swing arm 19 the other end of which is rotatably supported by the shaft 7 of the supply roll 11. A spring 20 is disposed between the arm 19 and a pin 8 on the supporting plate 6. A limit switch 21 is mounted on the supporting plate 6 adjacent to the upper edge of the arm 19.

The other end of the swing arm 19 may be pivotally supported on a pivot shaft, other than the shaft 7, on the supporting plate 6, but it is advantageous that the other end of the arm 19 be pivoted on the shaft 7 of the supply roll 11 because interference of the swing roller 13 with the supply roll 11 can be avoided during the movement of the swing roller 13 and the number of component parts can be minimized.

A stamping unit 22 is disposed on the supporting plate 6 adjacent to the separating plate 14 and consists of stamps 24 (three stamps being shown) which are actuated by pneumatic cylinders 23.

A web d to which the labels b are to be affixed is guided by a web guide roller 25 which is supported on the brackets 4 and disposed adjacent to the edge 14*a* of the separating plate 14 in opposed relationship with the stamping unit 22. A labelling or pressure roller 26 is provided to press a label b at one time against the web guide roller 25. The pressure roller 26 is moved in operation to the left as viewed in FIG. 1 by means of a pneumatic cylinder 27 on the supporting plate 6.

Figure 3:
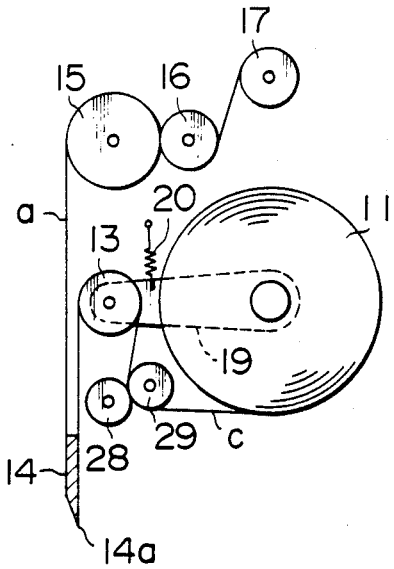
FIG. 3 is a fragmentary side elevation showing a modification of the apparatus of FIG. 1.
Figure 4:
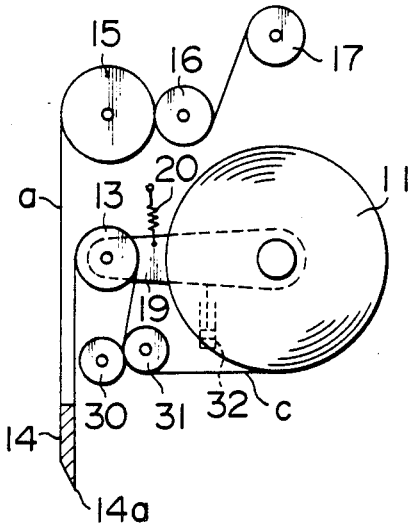
FIG. 4 is a fragmentary side elevation showing another modification of the apparatus of FIG. 1.

Instead of the electromagnetic brake 18 which applies braking force to the supply roll 11, a nip roller 28 and an inertia roller 29 having a great inertia may be used as shown in FIG. 3 to apply braking force to the label tape c. Furthermore, as shown in FIG. 4, a braking roller 30 and a guide roller 31 may be used instead of the electromagnetic brake 18. In this case, a pneumatic cylinder 32 is connected to the swing arm 19 to cause the latter to return from a downwardly swung position to its normal horizontal position shown in FIG. 4.

The stamping unit 22 is in opposed relationship with the separating plate 14 and its stamps 24 can be extended out of or retracted into the casing of the stamp unit 22 by the pneumatic cylinders 13. The stamps 24 have different colors, symbols, letters or characters.

Next the mode of operation of the above described apparatus will be described. As shown in FIG. 1, the label tape c is supplied from the supply roll 11, is guided by the guide roller 12 and the swing roller 13 and reaches the separating plate 14. At the separating plate 14, the label tape c is abruptly reversed in direction so that the labels b are separated successively from the base strip a due to their stiffness. The base strip a passes between the drive roller 15 and the pinch roller 16 and is wound around the take-up roller 17.

The label tape c is normally held stationary; that is, the electromagnetic brake 18 holds the supply roll 11 non-rotatable, while the web d, such as a printed sheet of paper, a coated sheet or a laminated sheet, is supplied continuously past the web guide roller 25.

Figures 2A, 2B, 2C, 2D:
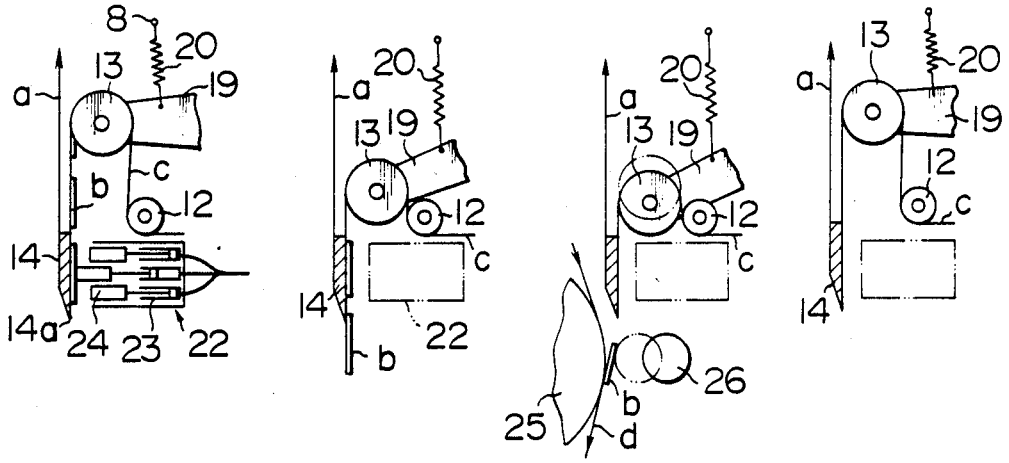
FIGS. 2A, 2B, 2C and 2D are fragmentary side views showing successive steps for affixing a label to a traveling web.

As shown in FIG. 2A, when the web d has any defect (which is detected automatically or by visual inspection), depending upon the type of defect, one of the stamps 24 is thrust by the pneumatic cylinder 23 so that a predetermined color, symbol, letter or character is stamped on the surface of the label b which is held stationary on the separating plate 14. After stamping, the base strip a is pulled upwardly by a certain length by the drive roller 15, but the supply roll 11 is held non-rotatable by the electromagnetic brake 18 so that the swing roller 13 is caused to move downward against the force of the spring 20 and consequently the label b is separated from the base strip a which is reversed in direction at the edge 14*a* of the separating plate 14. In this case, the label b is separated from the base strip a due to the stiffness of the label b, but, as shown in FIG. 2B, the label b is only partially affixed to the base strip a. The back surface (that is, the surface opposite to the surface upon which is stamped a mark such as a color, symbol, letter or character as described above) is coated with an adhesive layer. Therefore, when the labelling or pressure roller 26 is pressed immediately thereafter against the web guide roller 25, the label b is completely separated from the base strip a and is affixed to the web d which is being moved as shown in FIG. 2C. In this case, the position at which the label b is affixed is approximately the same as the position of the defect on the web d. An abrupt change in tension caused in the label tape c when the label b is separated from the base strip a is relieved and absorbed because the swing roller 13 which guides the label tape c is allowed to move downward together with the swing arm 19 against the force of the spring 20. In connection with the operation of the pressure roller 26, the brake 18 is released. After the label b is affixed to the web d, the swing roller 13 is caused to rise as shown in FIG. 2D under the force of the spring 20 acting on the swing arm 19. Upon arriving at the horizontal position, the arm 19 engages at its upper edge with the limit switch 21 (See FIG. 1) whereby the electromagnetic brake 18 is energized so that the label tape c, which has been paid out from the supply roll 11 by a length sufficient to bring the swing roller 13 to its initial position, is prevented from being supplied further. It will be understood that the limit switch 21 disposed adjacent to the upper edge of the arm 19 in its normal position to issue a signal for energizing the electromagnetic brake 18 functions to determine the length of the label tape c to be paid out from the supply roll 11.

In the modification shown in FIG. 3 using the nip roller 28 and the inertia roller 29, the label tape c passes therebetween, and when the label tape c moves suddenly, the inertia roller 29 applies brake thereto. In the modification shown in FIG. 4, the label tape c passes between the brake roller 30 and the guide roller 31. When the label tape c moves suddenly, the brake roller 30, which is being braked, applies brake thereto. The swing roller 13 which has been swung downwardly can be returned to its initial position by means of the pneumatic cylinder 32, overcoming the braking action of the brake roll 30. In this case, it is not necessary to normally interconnect the swing arm 19 and the cylinder 32. For instance, when the label b is pressed against the web d, the arm 19 must be kept free to swing resisting the force of the spring 20 so that a sudden change in tension of the label tape c can be relieved and absorbed. The pneumatic cylinder 32 can be connected to the arm 19 after the label b has been affixed to the web d to cause the arm 19 to move back to its normal position.

Figure 5:
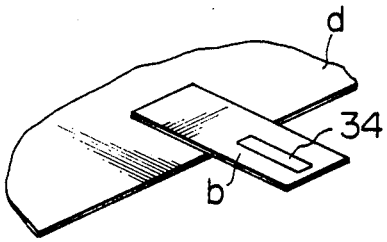
FIG. 5 is a perspective view showing a label affixed to a web.

In FIG. 5 a part of the web d is shown with a label b affixed thereto. The label b is affixed to the web d in about a half of its area, and a mark 34, such as a colored mark, symbol, letter or character, is stamped on the surface of the label b extending out of the web d. For example, four types of defects can be distinguished by the color of the label b itself and three marks stamped by the three stamps 24.

Figure 6:
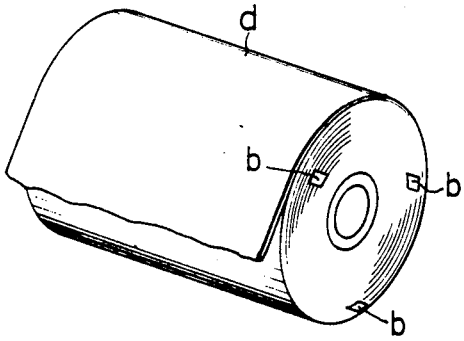
FIG. 6 is a perspective view of a web roll with labels affixed.

FIG. 6 shows a roll of the web d with labels b affixed. It is seen that the marked labels b are extended from the side face of the roll.

As described hereinbefore, the supporting plate 6 carrying the mechanisms for paying out the label tape c, for stamping and for affixing the stamped label b is adjustably movable along the guide rods 5. Because of this construction, the position of affixing the label b to the web d can be changed depending upon the width of the web d.

Figure 7:
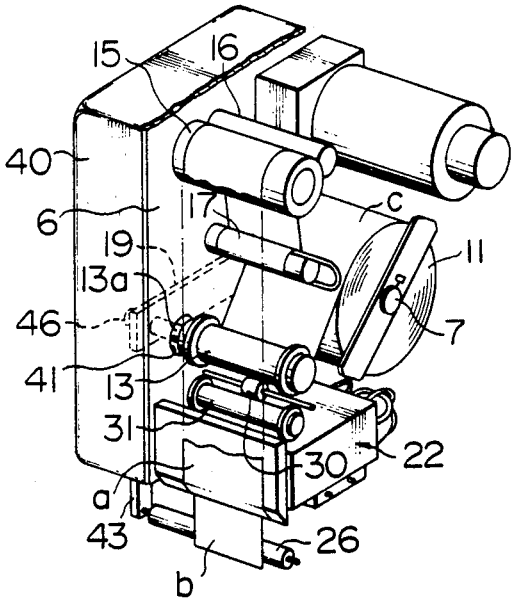
FIG. 7 is a perspective view of a second form of the apparatus in accordance with the present invention.

In FIGS. 7, 8, 9 and 10 a second embodiment of the present invention is shown which is substantially similar in construction and mode of operation to the first embodiment described above except for the following features. First, as best shown in FIG. 7, the arm 19 which carries the swing roller 13 is disposed within a cover 40, that is, behind the supporting plate 6. Therefore, the shaft 13*a* of the swing roller 13 is extended through a large-diameter hole 41 formed through the supporting plate 6 so that the swing roller 13 may swing downwardly.

Figure 8:
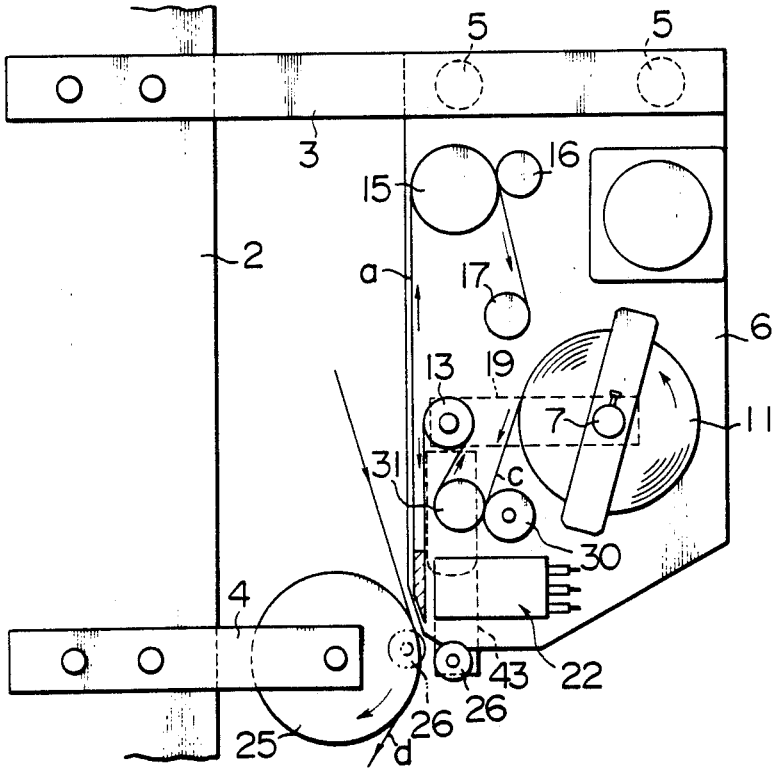
FIG. 8 is a side elevation, partly in section, of the apparatus shown in FIG. 7.
Figure 9:
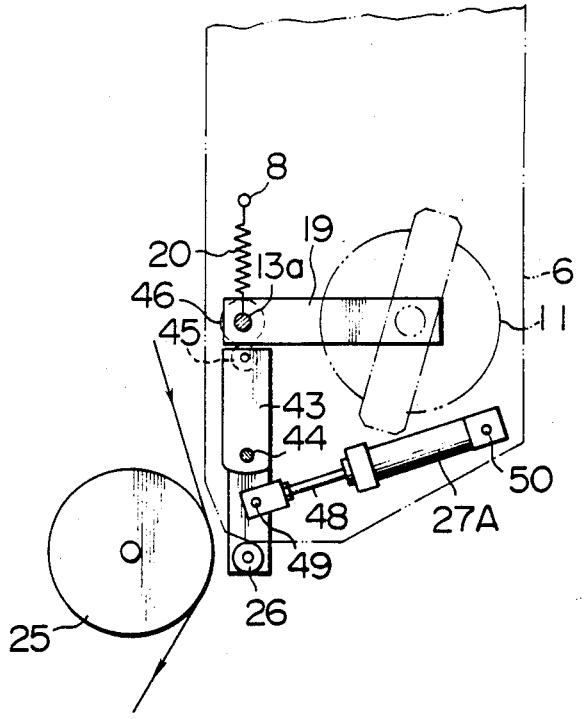
FIG. 9 is a fragmentary side view with a supporting plate removed to show a state in which the piston rod of a pneumatic cylinder is retracted.
Figure 10:
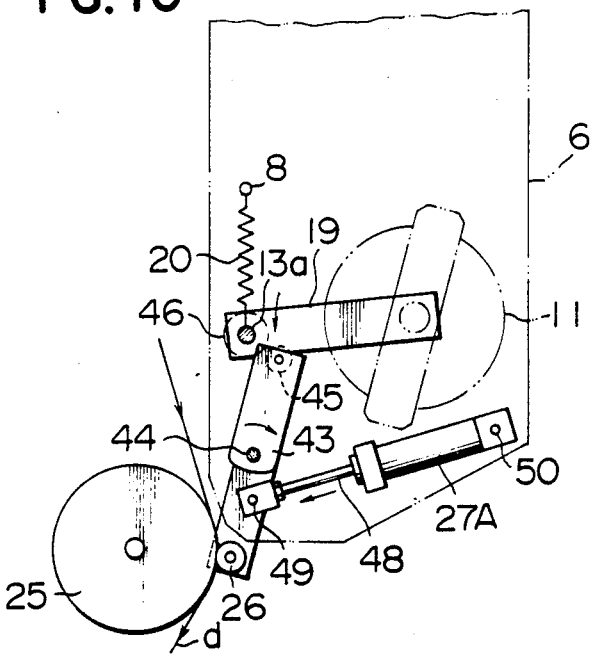
FIG. 10 is a view similar to FIG. 9 but showing a state in which the piston rod is advanced.

Second, as best shown in FIGS. 8, 9 and 10, a vertical lever 43 is disposed behind the supporting plate 6 and within the cover 40 and is pivoted at its intermediate part by a pivot pin 44 to the supporting plate 6. The labelling or pressure roller 26 is rotatably carried at the lower end of the vertical lever 43 while an engagement roller 45 is rotatably carried at the upper end of the lever 43 and engages with a roller 46 on the free end of the arm 19 as best shown in FIG. 9. The piston rod 48 of a pneumatic cylinder 27A is pivoted with a pivot pin 49 to the lever 43, and the proximal end of the cylinder 27A is pivoted to the supporting plate 6 by a pivot pin 50.

Therefore, as the piston rod 48 of the cylinder 27A is extended as shown in FIG. 10, the lever 43 is rotated about the pivot pin 44 in the clockwise direction so that the labelling or pressure roller 26 is caused to press against the web guide roller 25. When the piston rod 48 of the cylinder 27A is retracted, the lever 43 returns to its upright position so that the roller 45 engages with the roller 46 and the arm 19 is maintained in its substantially horizontal position as best shown in FIG. 9.

It is necessary to maintain this substantially horizontal position of the swing arm 19 by the engagement of the rollers 45 and 46 bacause without this engagement the swing roller 13 would be caused to move downward when the base strip a is pulled by the drive roller 15. As described hereinbefore, when the piston rod 48 of the cylinder 27A is advanced to cause the pressure roller 26 to be pressed against the web guide roller 25 for the labelling, the roller 45 at the top of the lever 43 is disengaged instantaneously from the roller 46, whereby the swing roller 13 is allowed to move downwardly to absorb the abrupt change in tension of the label tape c as in the case of the first embodiment of the invention.

What is claimed is:

1. Apparatus for affixing labels to a moving web, comprising:

(a) means for supplying a label tape, said label tape comprising a base strip and a multiplicity of labels removably adhered to said base strip;

(b) a resiliently supported movable roller being movable from a normal position to a shifted position, said label tape being passed from said supplying means around said movable roller;

(c) label separating means, said label tape being passed from said movable roller through said label separating means, said label separating means abruptly reversing the direction of said base strip causing said labels to be partially separated from said base strip;

(d) drive roller means, said drive roller means causing said base strip to pass through said label separating means;

(e) stamping means adapted to apply a marking on said labels, said stamping means being disposed adjacent the path of movement of said label tape from said movable roller to said label separating means;

(f) web guide means disposed adjacent said label separating means, said web guide means causing a web to pass adjacent said partially separated labels;

(g) a pressure roller disposed adjacent said label separating means at the opposite side of said partially separated labels from said web guide means, (h) actuating means causing said pressure roller to press against said web guide means causing a marked and partially separated label to be affixed to said web, said movable roller moving from said normal position toward said label separating means to said shifted position to absorb an abrupt variation in tension of said label tape caused by the affixing of said marked and partially separated label to said web; and (i) means for braking said supplying means, said braking means being released when said movable roller moves from said shifted position to said normal position.

2. Apparatus according to claim 1 wherein said movable roller comprises a swing roller mounted on a free end of a swing arm which is pivotally supported at its proximal end, said swing arm being attached to spring means which resiliently resist the shifting movement of said movable roller toward said label separating means.

3. Apparatus according to claim 1 wherein said label separating means comprises a separating plate having an edge and a side surface, said label tape passing along said side surface and the direction of said base strip being reversed at said edge.

4. Apparatus according to claim 3 wherein said stamping means is disposed opposite said side surface of said separating plate.

5. Apparatus according to claim 1 wherein said supplying means, said movable roller, said label separating means, said drive roller means, said stamping means, said pressure roller, said actuating means and said braking means are carried on a vertical supporting plate, said vertical supporting plate being horizontally adjustable relative to said web guide means and transversely adjustable relative to said web.

6. Apparatus according to claim 1 wherein said means for supplying a label tape comprises a label tape supply roll supported on a shaft and said means for braking said supplying means comprises a braking device provided on said shaft.

7. Apparatus according to claim 1 wherein said means for supplying a label tape comprises a label tape supply roll and said means for braking said supplying means comprises inertia roller means disposed between said supply roll and said movable roller to impart braking force to said label tape.

8. Apparatus according to claim 1 wherein said means for supplying a label tape comprises a label tape supply roll and said means for braking said supplying means comprises brake roller means disposed between said supply roll and said movable roller to impart braking force to said label tape.

9. Apparatus for affixing labels to a moving web, comprising:

(a) means for supplying a label tape, said label tape comprising a base strip and a multiplicity of labels removably adhered to said base strip;

(b) a resiliently supported movable roller being movable from a normal position to a shifted position, said label tape being passed from said supplying means around said movable roller.

(c) a substantially vertical lever pivotally supported at an intermediate part having engagement means at an upper end adapted to engage said movable roller;

(d) label separating means, said label tape being passed from said movable roller through said label separating means, said label separating means abruptly reversing the direction of said base strip causing said labels to be partially separated from said base strip;

(e) drive roller means, said drive roller means causing said base strip to pass through said label separating means;

(f) stamping means adapted to apply a marking on said labels, said stamping means being disposed adjacent the path of movement of said label tape from said movable roller to said label separating means;

(g) web guide means disposed adjacent said label separating means, said web guide means causing a web to pass adjacent said partially separated labels;

(h) a pressure roller mounted on a lower end of said substantially vertical lever being disposed adjacent said label separating means at the opposite side of said partially separated labels from said web guide means; and (i) actuating means connected to said substantially vertical lever causing a pivotal movement of said lever from a normal position to an actuated position causing said pressure roller to press against said web guide means causing a marked and partially separated label to be affixed to said web, said engagement means engaging said movable roller when said substantially vertical lever is in its normal position and said pressure roller is separated from the web guide means preventing said movable roller from shifting toward said label separating means, said engagement means being disengaged from said movable roller when said substantially vertical lever is in its actuated position allowing said movable roller to shift toward said label separating means to absorb an abrupt variation in tension of said label tape caused by the affixing of said marked and partially separated label to said web.

10. Apparatus according to claim 9 wherein said movable roller comprises a swing roller mounted on a free end of a swing arm pivotally supported at its proximal end, said swing arm being attached to spring means which resiliently resist the shifting movement of said movable roller toward said label separating means.

11. Apparatus according to claim 9 wherein said engagement means comprises a roller.

12. Apparatus according to claim 9 wherein said actuating means comprises fluid cylinder means.

* * * * *